US007413139B2

(12) United States Patent
Benvenuti et al.

(10) Patent No.: US 7,413,139 B2
(45) Date of Patent: Aug. 19, 2008

(54) DEVICE AND METHOD FOR CONTROLLING THE TENSION OF A WEBLIKE MATERIAL

(75) Inventors: Angelo Benvenuti, Lucca (IT); Franco Montagnani, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 564 days.

(21) Appl. No.: 10/515,315

(22) PCT Filed: May 22, 2003

(86) PCT No.: PCT/IT03/00315

§ 371 (c)(1),
(2), (4) Date: Jun. 6, 2005

(87) PCT Pub. No.: WO03/099691

PCT Pub. Date: Dec. 4, 2003

(65) Prior Publication Data

US 2005/0253013 A1 Nov. 17, 2005

(30) Foreign Application Priority Data

May 29, 2002 (IT) ..... FI2002A0088

(51) Int. Cl.
*B65H 23/06* (2006.01)

(52) U.S. Cl. ..... 242/421.1; 242/421.4

(58) Field of Classification Search ..... 242/420.02, 242/412.2, 413.1, 413.3, 421.1, 421.4
See application file for complete search history.

(56) References Cited

U.S. PATENT DOCUMENTS 3,202,376 A 8/1965 Dutro et al.
4,347,993 A 9/1982 Leonard
5,602,747 A * 2/1997 Rajala ..... 700/122
5,659,229 A * 8/1997 Rajala ..... 318/6
5,730,389 A 3/1998 Biagiotti
6,079,661 A 6/2000 Klimek et al.
6,168,108 B1 * 1/2001 Morley ..... 242/421.1

(Continued)

FOREIGN PATENT DOCUMENTS

EP 0 579 854 A1 1/1994

(Continued)

*Primary Examiner*—Sang Kim
(74) *Attorney, Agent, or Firm*—Breiner & Breiner, L.L.C.

(57) ABSTRACT

The control device comprises: at least one member (12; 12X) for regulating the speed of advance on the weblike material; a central control unit (41); a guiding roller (31) with mobile axis, over which the weblike material is run; and a position transducer (39) for detecting the position of the guiding roller (31) and for generating a position signal for controlling the speed of said weblike material. The guiding roller (31) is supported in a controlled position, and associated thereto is at least one sensor (37) for detecting a load (F) applied by the weblike material (N) on the guiding roller (31). In addition, an actuator (43) controls a displacement of the guiding roller according to a feedback signal generated by the sensor (37). The actuator is controlled so as to make up for variations of the load of the weblike material by moving the axis of the guiding roller, and the member for regulating the speed of advance of the weblike material (5) is controlled by said central control unit (41), according to the position signal, so as to maintain the axis of the guiding roller (31) in a position that is on average constant.

18 Claims, 5 Drawing Sheets

U.S. PATENT DOCUMENTS

| | | | | |
|---|---|---|---|---|
| 6,314,333 | B1 * | 11/2001 | Rajala et al. | 700/122 |
| 6,856,850 | B2 * | 2/2005 | Rajala et al. | 700/122 |
| 2002/0059013 | A1 | 5/2002 | Rajala et al. | |

FOREIGN PATENT DOCUMENTS

| | | | |
|---|---|---|---|
| EP | 0 822 912 | B1 | 8/2000 |
| GB | 2 294 033 | A | 4/1996 |
| WO | WO 00/56644 | A1 | 9/2000 |

* cited by examiner

DEVICE AND METHOD FOR CONTROLLING THE TENSION OF A WEBLIKE MATERIAL

TECHNICAL FIELD

The present invention relates to an unwinder device for unwinding a weblike material from a reel and feeding it to a processing line at a controlled tension. More in general, the present invention relates to a control device for controlling the tension of a weblike material coming out of a first station and fed to a second station of a processing system.

The invention also relates to a method for unwinding a weblike material from a reel and feeding it to a processing line, with an appropriate control of the tension. More in general, the invention relates to a method for controlling the tension of a weblike material along a feed path between a first station and a second station set in sequence, with the possible interposition of further stations, members or devices between them.

BACKGROUND OF THE INVENTION

In multiple industrial fields there arises the need for unwinding a weblike material from a reel for feeding it to a line for transformation or for processing. For example, in the field of paper converting, for the production of rolls of toilet paper, rolls of paper for domestic or industrial use, paper handkerchiefs or serviettes, one or more layers of paper known as "tissues" are unwound from one or more reels and fed to a line for transformation, which may comprise a rewinder and other machines arranged in series, to form rolls of a diameter equal to the diameter of the finished product and of large axial length. Said rolls or logs are then cut transversely and divided into a plurality of smaller rolls, which are sent on for packaging. Problems similar to those typical of the field of tissue paper may arise in other technological fields, for example in the processing of plastic film, adhesive tape, fabrics, non-wovens, cardboard and in general wherever there is the need to unwind a weblike material for feeding means or stations for processing.

For unwinding the reels, unwinding devices are used, which provide the unwinding motion to the reel by means of a central mechanism, i.e., one that transmits motion to the axis of the reel, or else by means of a peripheral mechanism, i.e., one that transmits motion by means of a member (typically a belt), which is in contact with the outer periphery of the reel. Unwinders of this type are described, for example, in EP-B-0822912 and in U.S. Pat. No. 5,730,389. Other unwinders for weblike material are described in GB-A-2294033, U.S. Pat. No. 3,202,376, WO-A-0056644.

The weblike material must be fed to the line for transformation at a tension that is substantially constant. This is rendered difficult by the fact that the reels from which the weblike material is unwound frequently present an irregular shape, for example an elliptical cross section or in any case a deformed and non-circular cross section.

Various systems have been studied for controlling the tension of the weblike material unwound from reels. According to a first approach, the weblike material is run over a dandy roll, i.e., one supported with a mobile axis of rotation, typically by means of a pair of oscillating arms that are hinged about an axis of oscillation parallel to the axis of rotation of the roll itself. When the tension of the weblike material tends to vary, for example on account of the irregularity of the cross section of the reel, the dandy roll shifts, so preventing a variation of tension in the weblike material. A position transducer, for example an angular position transducer, detects the displacement of the dandy roll and generates a feedback signal, which is used by a control unit for modifying the speed of feed of the weblike material, in particular by accelerating or decelerating the reel.

An unwinder device with a dandy roll for controlling the tension of the weblike material is described in U.S. Pat. No. 6,079,661.

This type of control is not satisfactory in that it is particularly unstable. In fact, a possible deformation of the reel causes an oscillation of the dandy roll with a frequency of the same order of magnitude as the frequency of the rotation of the reel. The feedback signal that derives therefrom causes cyclic accelerations and decelerations, with a similar frequency, of the speed of rotation of the reel. On account of the high inertia of the reels of weblike material, the correction made by this type of control is retarded with respect to the onset of the variation of tension, and hence is not effective.

According to a different approach, the weblike material is run over a guiding roller, to which there are associated load cells that detect the reaction on the axis of the roll, due to the load applied on the roll by the weblike material in tension. A possible irregularity of the cross section of the reel tends to have repercussions in the form of a periodic variation of the load applied on the guiding roller. This variation is detected by the load cells, which generate a feedback signal that is used for intervening on the speed of rotation of the reel with the purpose of making up for the oscillations in tension.

Also this solution is not satisfactory for the same reasons that render inadequate the solution that utilizes the dandy roll, and moreover induce greater jumps of tension in the weblike material, even though—as compared to the dandy-roll solution—it affords the advantage of simplifying the path of the weblike material.

Similar problems of control of the tension of a weblike material may arise also in situations different from the typical one of unwinding from a reel for feeding a station set downstream of the station comprising the unwinder. In general, problems of control of the tension of a weblike material may arise in all those situations in which the weblike material is fed from one to the other of two stations set in sequence (not necessarily adjacent to one another) along a feed path, when the one or the other of the stations may undergo oscillations in the speed of supply or of absorption of the weblike material itself.

OBJECTS AND SUMMARY OF THE INVENTION

An object of the present invention is to provide an unwinder device, especially but not exclusively for tissue paper, which will overcome or mitigate the drawbacks referred to above.

Another object of the present invention is to provide a method for unwinding a weblike material which will overcome or reduce the drawbacks of the known methods, rendering more efficient the control of the tension of the weblike material.

More in general, the object of the present invention is to provide a device and a method for effective control of the tension of a weblike material in a processing line or system, comprising at least two stations set in succession along the path of the weblike material.

According to a first and more general feature, then, the present invention envisages a device for controlling the tension of a weblike material coming out of a first station and fed to a second station of a system, which comprises:

at least one member for regulating the speed of advance of the weblike material along a path of advance between said first station and said second station;

a central control unit;

along said path of the weblike material, a guiding roller with mobile axis, over which is run said weblike material; and a position transducer for detecting the position of the guiding roller and for generating a position signal for regulating the speed of said weblike material, characterized in that: said guiding roller is supported in a controlled position, and associated thereto is at least one sensor for detecting a load applied by the weblike material on the guiding roller; an actuator controls a controlled displacement of the guiding roller according to a feedback signal generated by said sensor, the actuator being controlled so as to make up for variations of said load moving the axis of the guiding roller; and said member for regulating the speed of advance of said weblike material is regulated by said central control unit, according to the position signal, so as to maintain the axis of the guiding roller in a position that is on average constant.

Since the guiding roller is kept in a controlled position and is not (as occurs in traditional devices) free to move or oscillate under the effect of the tension of the weblike material run over it, it is possible to measure the load exerted on the roll itself by the weblike material and, on basis of this, to generate a feedback signal that determines the displacement, which is no longer spontaneous, but instead controlled, of the roll to make up for the oscillations in tension. The controlled displacement of the guiding roller is continuously monitored by means of the position transducer. Unlike what occurs in traditional devices, the oscillation detected by the transducer does not directly cause a variation of the speed of advance of the weblike material. Instead, the control unit performs an integration of the signal to determine the mean position in time of the guiding roller. Only when this mean position departs excessively from a predetermined position does it performs a correction of the speed of feed of the weblike material.

The member for regulating the rate of feed of the weblike material may be a drive member or a braking member or also a combination of the two in order to ensure a balanced control of a tensile force and of a resistant force.

Further features of the device for controlling the tension of the weblike material are specified in the attached claims.

According to a different feature, the invention relates specifically to an unwinder device, comprising:

at least one member for regulating the speed of unwinding of the weblike material from a reel;

a central control unit;

a guiding roller with mobile axis, over which is run said weblike material; and a position transducer for detecting the position of the guiding roller and for generating a position signal for regulating the speed of unwinding of said weblike material.

In a device of the above type according to the invention, it is envisaged that: the guiding roller will be kept in a controlled position; to the guiding roller is associated at least one sensor for detecting a load applied by the weblike material on the guiding roller; the movement of the guiding roller is controlled by an actuator according to a feedback signal generated by said sensor, the actuator being controlled so as to make up for variations of said load by moving the axis of the guiding roller; and the member for regulating the speed of the weblike material is controlled by said central control unit, according to said position signal, so as to maintain the axis of the guide roller in a position that is on average constant.

With a device of this kind the regulation of the speed of unwinding of the reel or else of the speed of advance of the weblike material is performed only when there is a tendency for the guiding roller to shift away from a mean position. Regulation is thus made on the basis of a feedback signal obtained for example by the integration in time of the positions of the guiding roller and hence particularly stable. Notwithstanding the slowness of the possible variation of the speed of advance of the weblike material, the device enables accurate control of the tension thanks to the movement of the guiding roller, which is controlled in a positive way by the actuator on the basis of the tension detected on the material itself. The system of regulation, then, intervenes in a timely way and without any delay, thus overcoming the inertia of traditional systems that correct the position of the guiding roller by acting directly upon the speed of rotation of the reel or else upon the rate of feed of the weblike material.

Broadly speaking, the member for regulating the speed of the weblike material may be a motor-driven member, which causes the unwinding of the weblike material by application of a tensile force on the material itself in a portion in which it is already unwound, for example by means of a pair of motor-powered drive cylinders set along the path of unwinding of the weblike material.

Preferably, however, when the weblike material is unwound off a reel, the member for regulating the speed of the weblike material acts directly on the reel, axially and/or peripherically. For example, it may comprise one or more rollers or cylinders for supporting the reel, which by turning causes it to be unwound, or else one or more belts for unwinding set in contact with and pressed against the outer surface of the reel, either above it or underneath it. There may also alternatively be provided members that transmit the necessary torque to the reel axially, i.e. via a central spindle, or else there may be hypothesized solutions of a mixed or combined type. According to a different embodiment, the weblike material may be unwound by traction force by means of a traction member, and the reel may be braked by means of a braking member, which is controlled by the control unit for modifying the rate of feed of the weblike material. In this case, therefore, the member for regulating the speed of feed of the weblike material is constituted by a braking member, instead of by a motor-driven member.

The guiding roller may be supported in any appropriate way, provided that it is, on the one hand, possible to keep it in a controlled position and, on the other, movement thereof is enabled, i.e. the displacement of the rotation axis for modifying the path of the weblike material run over it, with the purpose of making up for temporally limited variations of the tension. It may, for example, be possible to use a guiding roller mounted on slides that are mobile along a rectilinear or curvilinear guide, with a position transducer for detecting the position of the roll along the guide.

However, according to a preferred embodiment of the device for controlling the tension and of the unwinder device according to the present invention, the guiding roller is supported by oscillating arms that oscillate about an axis of oscillation parallel to the axis of said guiding roller.

According to a further feature, the invention relates also to a method for unwinding a weblike material from a reel, in which the weblike material is run over a guiding roller with a mobile axis of rotation and in which the speed of unwinding of the weblike material from said reel is regulated according to the displacement of said guiding roller. Characteristically, according to the invention, there is envisaged:

maintaining the guiding roller in a controlled position;

detecting a load applied by the weblike material upon said guiding roller;

controlling, in a positive way, by means of an actuator, the position of the axis of said guiding roller to compensate, with a displacement of the guiding roller, for a variation of said load; and making up for the variations of the mean position of the axis of said guiding roller by modifying the speed of unwinding of the weblike material from the reel.

According to an advantageous embodiment of the method according to the present invention, there is envisaged generation of a feedback signal according to the load on the guiding roller and control of the movement of said guiding roller according to said feedback signal.

To obtain a stable feedback on the speed of unwinding of the weblike material, according to a preferred embodiment of the invention there is envisaged: integrating the position of the axis of the guiding roller over an interval of time; calculating the mean position of said axis; and modifying the speed of unwinding of the weblike material from said reel to maintain the mean position within a predetermined interval.

According to a more general feature, the present invention relates to a method for controlling the tension of a weblike material coming out of a first section and fed along a path of advance to a second section of a system, in which said weblike material is run over a guiding roller with a mobile axis of rotation and in which the speed of advance of the weblike material along said path is regulated according to the displacement of said guiding roller. Characteristically, according to the invention, there is envisaged:

maintaining the guiding roller in a controlled position;

detecting a load applied by the weblike material upon said guiding roller;

controlling, in a positive way, by means of an actuator, the position of the axis of said guiding roller to make up, with a displacement of the guiding roller, for a variation of said load; and compensating the variations of the mean position of the axis of said guiding roller by modifying the speed of advance of the weblike material along said path.

The invention also relates to a production line for transformation of a weblike material comprising at least two sections or stations in sequence, between which there is set a device for controlling the tension of the weblike material, operating as described above.

Further advantageous features and embodiments of the invention are specified in the attached claims.

BRIEF DESCRIPTION OF THE DRAWINGS

A better understanding of the invention will be obtained from the ensuing description and from the annexed table of drawings, which illustrate a practical non-limiting embodiment of the invention. In the drawings, in which arts that are the same are designated by the same reference numbers.

DETAILED DESCRIPTION OF THE PREFERRED EMBODIMENTS OF THE INVENTION

With reference to FIGS. 1 to 4, the concept underlying the invention will be illustrated in an application to an unwinder device for unwinding a reel of a weblike material and feeding the material to a section set downstream of the unwinder.

Figure 1:
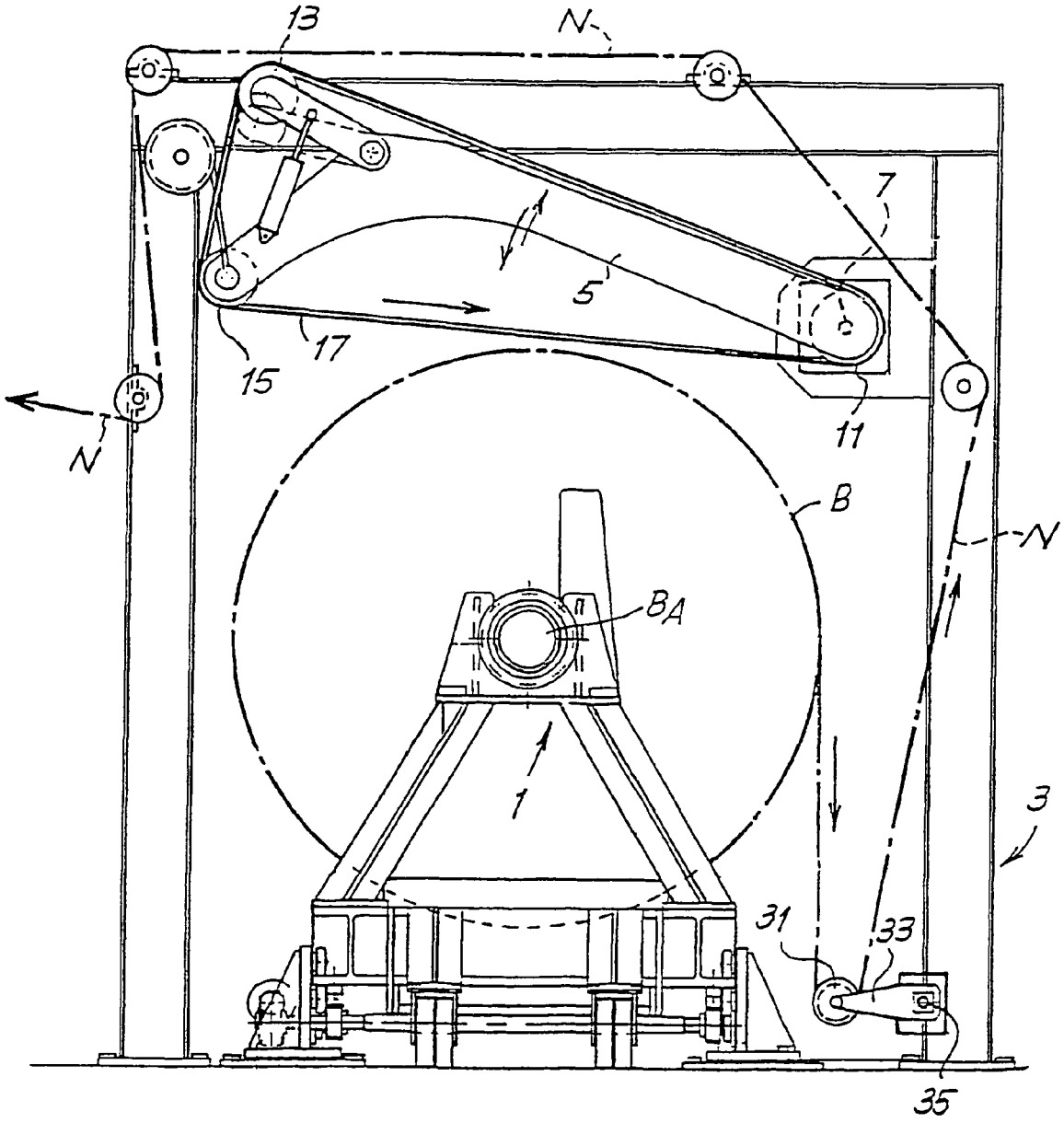
FIG. 1 is a schematic side view of an unwinder to which there is applied the device according to the invention.

FIG. 1 is a schematic illustration of a side view of a possible unwinder, to which there is applied the device according to the invention. The unwinder has a support 1 for a reel B of weblike material to be unwound, said weblike material N being wound on a central core A. The support 1 comprises, in this example, a carriage that is mobile in a direction orthogonal to the plane of the figure, which is located inside a fixed structure 3, which defines a path of unwinding of the weblike material and on which there is supported a motor-driven member which drives the reel B in rotation about its own axis.

The motor-driven member is as a whole designated by 5. It is hinged in 7 to the fixed structure 1 and comprises a plurality of belts 17, which are run over rollers or pulleys 11, 13, 15, of which the pulley 11 in the example illustrated is motor-driven by means of a motor 12. The motor-driven member is equipped with means, which are in known per se and are not described herein, that keep the belts 17 in contact with the periphery of the reel B.

Along the path of the weblike material N there is set a guiding roller 31 supported by arms 33, which are hinged about an axis 35 parallel to the axis of rotation of the guiding roller and fixed to the fixed structure 3.

Figure 2:
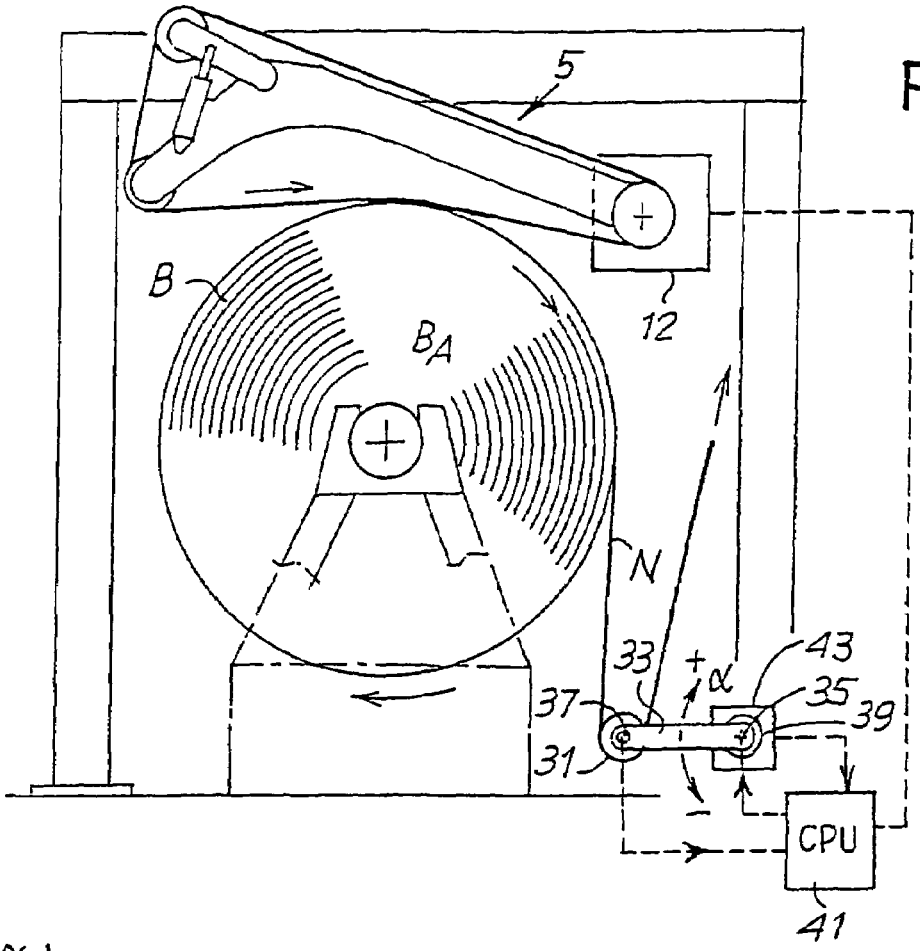
FIG. 2 is a block diagram of the device.

As shown in particular in the block diagram in FIG. 2, associated to the supports of the roll 31 are load sensors, for example load cells, which are designated as a whole by 37. Associated to the arms 33 is an encoder or other angular-position transducer, designated as a whole by 39, designed for detecting the angular position of the arms 33 and the corresponding displacements about the axis 35. The arms for supporting the roll 31 are held in a controlled position, i.e., they are substantially immobilized, by an actuator associated thereto. In this way, the guiding roller is not free to oscillate under the action of the tension applied by the weblike material, and consequently the load cells 37 are able to detect a force of reaction of the supports of the roll 31 which is dependent upon the tension of the weblike material.

The load cells 37 and the angular-position transducer 39 are connected to a control unit 41. This receives, then, at input from the load cells 37, a signal that is proportional to the force of reaction on the supports of the guiding roller 31, and from the transducer 39 a signal indicating the angular position of the arms 33.

The central control unit 41 is in turn connected to a motor 43 or other appropriate actuator, which, on the one hand, keeps the arms 33 and hence the roll 31 immobilized in a controlled position and, on the other hand, (under the control of the central control unit 41) controls the movement of oscillation of the arms 33 in the manner and for the purposes described in detail in what follows. The central control unit 41 is moreover connected to the motor 12 that controls the belts 17 of the motor-driven member 5, and regulates the speed of unwinding according to the modalities described in what follows.

In traditional systems, the guiding roller 31 moves by oscillating about the axis 35 as a result of the variation of tension of the weblike material N, and the angular position of the arms 33, detected by the encoder or other angular-position transducer 39, determines a feedback signal that causes acceleration or deceleration of the motor 12 for restoring the original position of the arms 33 and hence of the roll 31.

Instead, according to the invention, the arms 33 are kept stationary until the motor 43 is actuated. A variation of the tension on the weblike material N, for example due to a deformation of the reel B, consequently causes a variation of the load detected by the load cells 37. The latter generate a feedback signal according to the tension detected, which, by means of the central control unit 41, causes an actuation of the motor 43. In practice, the motor 43 or other equivalent actuator causes—in response to an increase or a reduction of the tension in the weblike material N—an oscillation of the arms 33. The movement of oscillation is not caused directly by the force applied by the weblike material, but rather controlled by a positive control.

If the variation in tension is, for example, a cyclic variation due to an ovalization of the reel, i.e., to an oval or elliptical shape of the cross section of the reel itself, the position of the arms 33 varies cyclically, but the mean position remains substantially unvaried. The position signal generated by the position transducer 39 remains on average constant.

Figure 3:
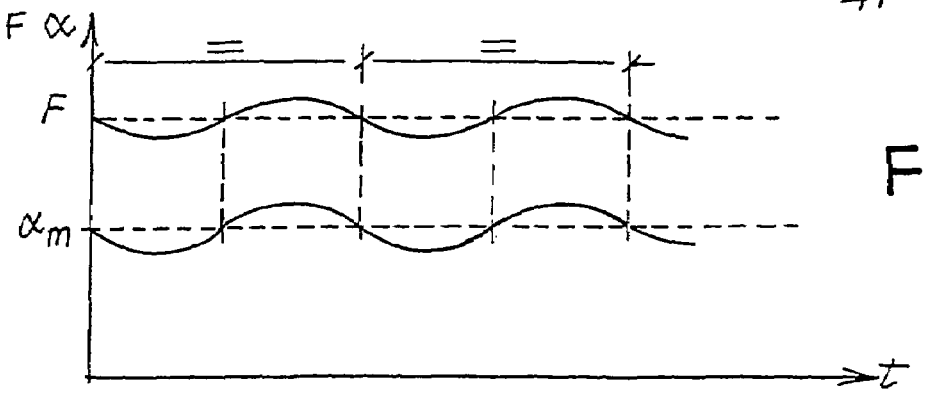
FIG. 3 is a graph plotting the trend of the angular position of the supporting arm of the guiding roller in time in a first possible mode of operation.

This situation is represented in the graph of FIG. 3, where on the abscissa there appears the time and on the ordinate a represents the angular position of the arms 33. The symbol $\alpha_m$ represents the mean position, e.g. with the arms 33 horizontal.

A periodic oscillation like the one represented by the curve F of the tension in the weblike material causes an oscillation having a trend that is substantially the same in the signal generated by the load cells 37 and a consequent oscillation controlled positively by the motor 43, which tends to compensate this periodic variation of the tension. The oscillation of the arms 33 is indicated by the curve $\alpha$.

The angular position of the arms is detected by the angular-position transducer 39. If for any reason the mean position of the arms 33 tends to vary, departing from the mean position $\alpha_m$, this circumstance is detected by the central control unit 41, which on the basis of the position signal coming from the transducer 39 generates a control signal for the motor 12. The signal is such as to cause a gradual acceleration or a gradual deceleration of the belts 17 and hence of the reel B to make up for the drift of the mean position of the arms 33 with respect to the pre-set mean position $\alpha_m$.

Figure 4:
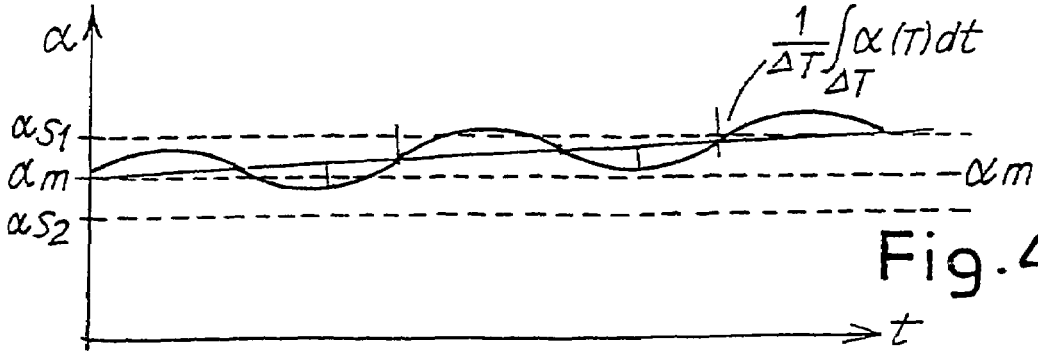
FIG. 4 is a graph plotting the trend of the angular position of the supporting arm of the guiding roller in time in a second possible mode of operation.

The graph of FIG. 4 is a schematic representation of a situation that calls for the intervention of the correction on the speed of rotation of the motor 12 and hence of the reel B. As may be noted from the graph, the mean value of the curve $\alpha$ varies in time. The ratio between the integral of the function $\alpha(t)$ and the integration time interval does not remain constant, but rather (in the example illustrated) tends to increase.

Assuming that the angle $\alpha$ is measured in the clockwise direction, when the mean value exceeds an upper threshold value $\alpha_{s1}$, the device intervenes with an acceleration of the motor 12. This causes a gradual lowering of the mean position of the arms 33 until the pre-set mean position $\alpha_m$ is reached. When the lower threshold value $\alpha_{s2}$ is overstepped, this causes an opposite reaction of the system, with a deceleration of the motor 12 and hence of the reel B.

From the above description, it may be readily understood that the control performed in this way enables a reduction to a minimum of the interventions of acceleration or deceleration of the reel B and above all enables a variation in the angular velocity of the reel, which is very slow, with consequent advantages in terms of inertia. The system is stable in so far as any periodic oscillations of the tension in the weblike material are compensated for by the motor 43, without interventions on the speed of unwinding of the weblike material, whereas only when the mean position of the arms 33 tends to depart from the pre-set value is it necessary to intervene, with adequately long time intervals, on the speed of rotation of the reel B.

Figure 5:
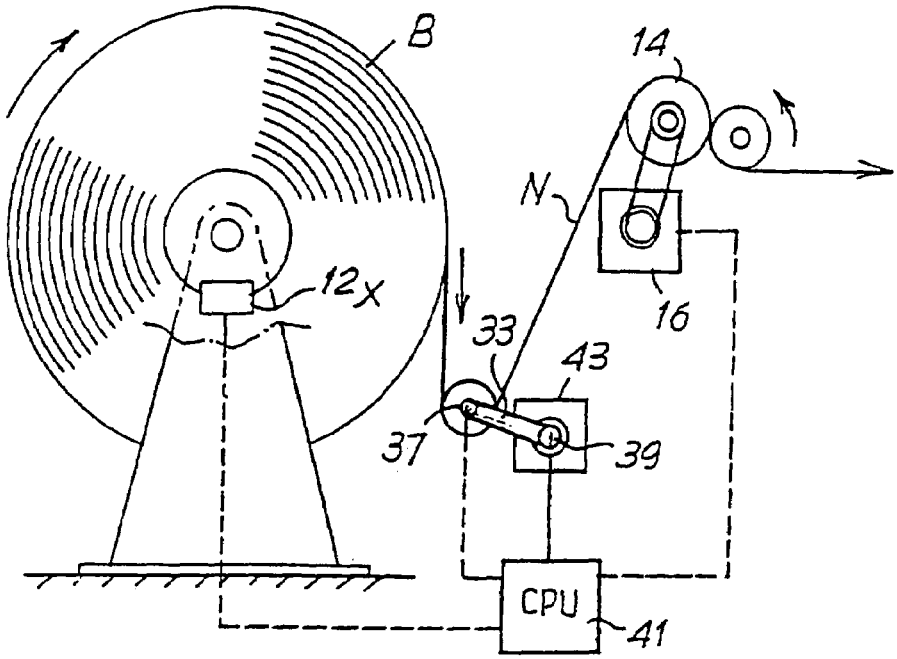
FIG. 5 is a diagram of an unwinder device according to the invention in a different embodiment.

FIG. 5 illustrates a diagram, similar to the diagram of FIG. 2, of an unwinder device in which the unwinding of the reel B is obtained by application of tensile force on the weblike material and in which the speed of advance of the weblike material is regulated by means of a braking member instead of by means of a motor-driven member. Parts that are the same or are equivalent are designated by the same reference numbers as those adopted in FIG. 2. The unwinder 5 comprises, in this case, a braking member designated by 12X, which applies a braking torque on the axis of the reel B. The braking member 12X is connected to the central control unit 41. The weblike material is unwound by exertion of a tensile force by means of a pair of motor-powered drive cylinders 14, which are driven by means of a motor drive 16. Also the latter may be interfaced to the central control unit 41. The drawing of the weblike material may be obtained also by means of the members of the machine or station that is located downstream of the unwinder, instead of by means of a purposely provided pair of motor-powered drive cylinders. The device operates in a way similar to what has been described previously, with the difference that the possible deviation of the mean position of the arms 33 from a pre-set position determines, by means of the central control unit 41, a control signal to the braking member 12X, which modifies the resistant torque applied for reducing or increasing the speed of feed of the weblike material N, according to the same modalities described previously.

Figure 6:
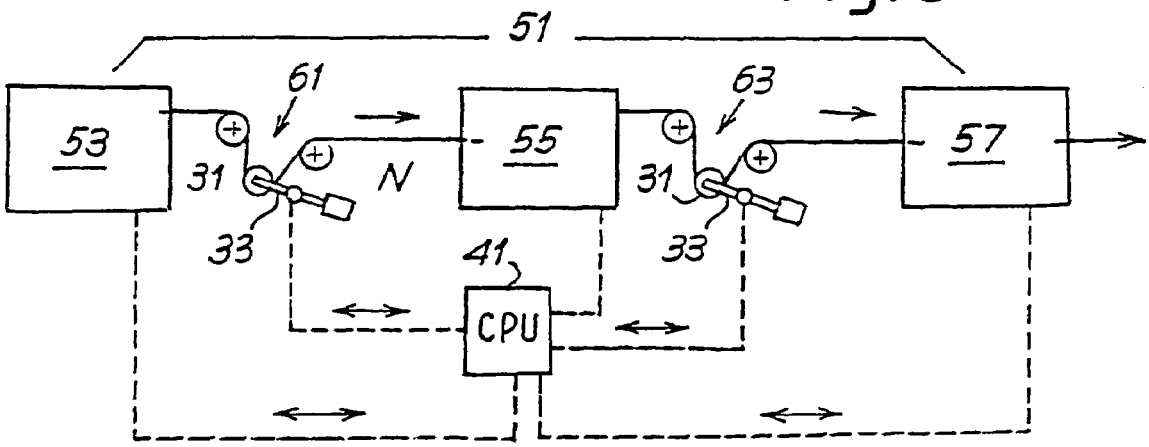
FIG. 6 is a diagram of a generic processing line with three sections in succession and two devices for controlling the tension, set between the sections.

FIG. 6 is a highly schematic illustration of a further application of the principle underlying the present indention, to a generic transformation line, designated by with 51 and comprising three generic sections 53, 55, 57 set in sequence along the path of the weblike material N. Each section 53, 55, 57 may comprise any type of machinery that operates at a fixed or variable speed on the weblike material N. Set between the stations or sections 53, 55 and between the sections 55 and 57 are respective devices for controlling the tension of the weblike material, which are designated by 61 and 63. Each of said devices comprises a pair of oscillating arms 33, which support respective guiding rollers 31 of the weblike material N. Each pair of arms is held in an angular position controlled by an actuator 43, and the angular position is detected by a transducer 39. Associated to the supports of the rollers 31 are load cells 37 for detecting the force of reaction applied on the rollers 31 by the weblike material.

The load cells associated to the two rollers 31, as well as the respective position transducers 39 and the actuators 43 are interfaced to a central control unit 41, to which are connected also the three sections 53, 55, 57 of the line 51. By means of the actuators 43 the central control unit controls, according to the signals coming from the load cells 37, the movement of oscillation of the rollers themselves for maintaining the tension constant, according to the same procedure described with reference to the unwinder of FIGS. 1 to 4. The mean position in time of the arms 33 is calculated by the central control unit 41, which consequently may generate (if necessary) a signal for correction of the output speed of the weblike material from the section upstream or of input speed of the weblike material in the section set downstream with respect to the control device 61, 63, the guiding roller of which is moving away, as regards the mean position, from the pre-set position.

The control devices 61, 63 may also have the function of maintaining constant the tension of the weblike material in the respective stretch of the feed path when the section upstream delivers the material itself at a substantially constant speed, and the section set downstream absorbs the weblike material with a cyclic variation of speed, or vice versa. In this case, the cyclic variation of the tension of the weblike material deriving from the variation of the speed with which the weblike material is absorbed by the section set downstream (or delivered by the section set upstream) is compensated for by the controlled oscillation of the corresponding guiding roller, without modifying the constant or substantially constant rate of output of the weblike material by the upstream section (or the speed of absorption of the downstream section).

Figure 7:
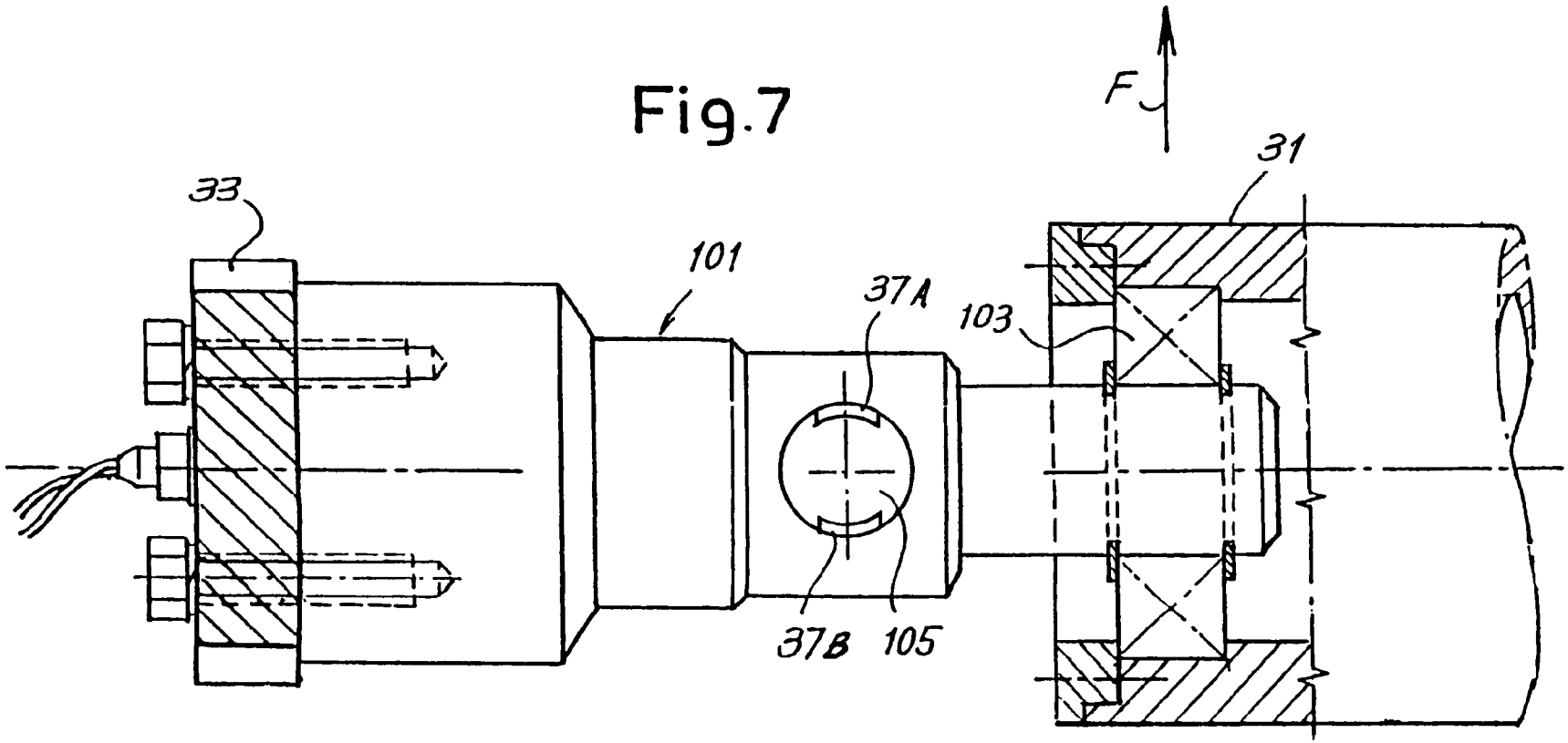
FIG. 7 is a cross section of a supporting pin for the guiding roller with the corresponding sensors for detection of the load applied by the weblike material.

FIG. 7 is a schematic illustration of an embodiment of one of the two end supports of the guiding roller 31 in any of the embodiments so far described. The support is formed by a pin 101 constrained to the respective arm 33 and on which there is fitted a bearing 103 for supporting the guiding roller 31. The pin 101 has a transverse through hole 105, orthogonal to the axis of the pin itself and with an axis orthogonal to the direction of the resultant F of the forces applied by the supporting bearing 103. Set inside the hole 105 are two load cells arranged opposite to one another, designated by 37A and 37B. The orientation of the resultant F with respect to the axis of the hole 105 and to the position of the load cells 37A, 37B is such that the latter are able to detect even very small flexural deformations of the pin 101 due to the variation of the resultant force F, and hence in practice of the tension on the weblike material.

Figure 8:
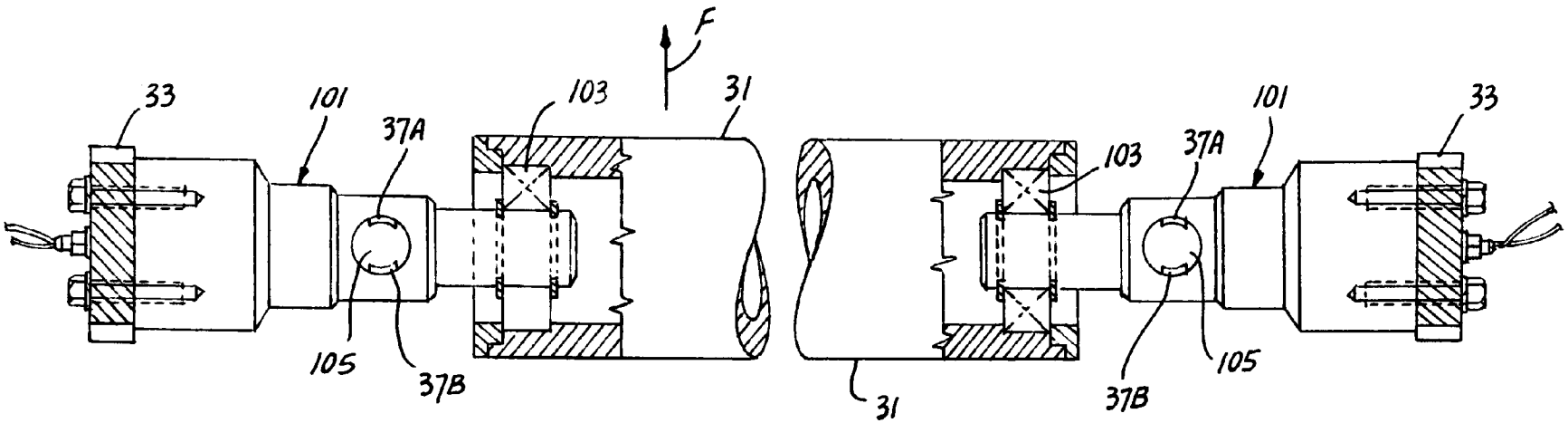
FIG. 8 is a cross section showing two sensors applied to two supports of the guiding roller.

FIG. 8 shows a schematic illustration of the embodiment of FIG. 7 presented in each end of the supporting pin for the guiding roller.

It is understood that the table of drawings illustrates only a practical embodiment of the invention, which may vary in the forms and arrangements, without thereby departing from the scope of the concept underlying the invention. The possible presence of reference numbers in the annexed claims merely has the purpose of facilitating reading thereof in the light of the foregoing description and of the attached drawings and in no way limits the scope of protection defined by the annexed claims.

The invention claimed is:

1. A control device for controlling tension of weblike material coming out of a first station and fed to a second station of a system comprising: at least one member for regulating speed of advance of said weblike material along a feed path between said first station and said second station; a central control unit moves the weblike material along the path, said weblike material is run over a guiding roller with a mobile axis; and a position transducer for detecting position of the guiding roller and for generating a position signal for controlling the speed of said weblike material; wherein said guiding roller is supported in a controlled position and associated therewith at least one sensor for detecting a load applied by the weblike material on the guiding roller; an actuator for controlling displacement of said guiding roller according to a feedback signal generated by said sensor, the actuator being controlled so as to make up for variations of said load moving the axis of the guiding roller; and said member for regulating the speed of advance of said weblike material is controlled by said central control unit according to the position signal to maintain the axis of the guiding roller in a position that is on average constant; wherein said control unit determines, based on the position signal coming from said transducer, trend in time of the position of the axis of said guiding roller; and said control unit causes, by means of said member for regulating the speed of advance of the weblike material, a variation of the speed of the weblike material when a mean value of said position exceeds a threshold value from a pre-set mean position ($\alpha_m$).

2. The device according to claim 1, wherein said member for regulating the speed of advance of said weblike material is a drive member which applies a driving force upon the weblike material.

3. The device according to claim 1, wherein said member for regulating the speed of advance of said weblike material is a braking member which applies a braking force upon the weblike material.

4. The device according to claim 1, wherein said member for regulating the speed of advance of the weblike material acts upon a reel on which said weblike material is wound and from which said weblike material is unwound at a tension controlled by said device.

5. The device according to claim 1, wherein said guiding roller is supported by oscillating arms that oscillate about an axis of oscillation parallel to the axis of said guiding roller; said position transducer detects angular position of said arms; and said actuator controls oscillation of the arms about said axis of oscillation.

6. The device according to claim 5, said position transducer is an angular-position transducer.

7. The device according to claim 1, wherein said sensor for detecting the load applied on the guiding roller by the weblike material is associated with a support of the guiding roller.

8. The device according to claim 1, further comprising two sensors applied to two supports of the guiding roller.

9. The device according to claim 1, wherein said at least one sensor for detecting the load applied on the guiding roller is a load cell.

10. An unwinder device comprising at least one support for a reel of weblike material to be unwound and to be supplied to a station set downstream of said unwinder along a system, comprising a control device for controlling tension of the weblike material unwound from said reel, according to one of claims 1-9,6.

11. A line for transformation of a weblike material comprising at least a first station and at least a second station set in sequence along a path of advance of the weblike material; with means for controlling tension of the weblike material along said path of advance, comprising at least a control device for controlling the tension of the weblike material according to one of claims 1-9,6.

12. The line according to claim 11, further comprising an unwinder in said first station, the control device for controlling the tension of the weblike material controlling the tension of the weblike material unwound from said unwinder.

13. The line according to claim 12, wherein set downstream of said unwinder there is provided a station comprising a rewinder.

14. A method for controlling tension of a weblike material coming out of a first section and fed along a path of advance to a second section of a system, wherein said weblike material is run over a guiding roller with a mobile axis of rotation, and wherein speed of advance of the weblike material along said path is regulated according to displacement of said guiding roller, comprising:

maintaining said guiding roller in a controlled position;

detecting a load applied by the weblike material upon said guiding roller;

positively controlling, by means of an actuator, position of the axis of said guiding roller to make up, with a displacement of the guiding roller, for a variation of said load;

making up for variations of a mean position of the axis of said guiding roller by modifying the speed of advance of the weblike material along said path; wherein integrating the position of the axis of the guiding roller over an interval of time; calculating the mean position of said axis; and modifying the speed of advance of the weblike material along said path for maintaining the mean position within a predetermined interval.

15. The method according to claim 14, wherein a feedback signal is generated according to said load and movement of said guiding roller is controlled according to said feedback signal.

16. The method according to claim 14 or 15, wherein the axis of the guiding roller is angularly mobile about an axis of oscillation.

17. The method accordingly to claim 14, wherein said weblike material is unwound from a reel in said first station.

18. The method according to claim 17, wherein the speed of advance of the weblike material is modified by acting upon a motor-driven member which drives in rotation said reel.

* * * * *

UNITED STATES PATENT AND TRADEMARK OFFICE

CERTIFICATE OF CORRECTION

PATENT NO. : 7,413,139 B2
APPLICATION NO. : 10/515315
DATED : August 19, 2008
INVENTOR(S) : Angelo Benvenuti et al.

It is certified that error appears in the above-identified patent and that said Letters Patent is hereby corrected as shown below:

Column 1,

Line 67, "an angular position" should read -- an angular-position --.

Column 5,

Line 57, "in which arts that" should read -- in which parts that --.

Column 7,

Line 33, "the ordinate a" should read -- the ordinate α --.

Column 8,

Line 41, "the present indention," should read -- the present invention, --.

Column 10,

Line 46, Claim 10, "claims 1-9, 6." should read -- claims 1-9. --.

Line 53, Claim 11, "claims 1-9, 6." should read -- claims 1-9. --.

Column 12,

Line 8, Claim 17, "The method accordingly to" should read

-- The method according to --.

Signed and Sealed this

Seventh Day of July, 2009

JOHN DOLL
*Acting Director of the United States Patent and Trademark Office*